US010314380B2

(12) United States Patent
Schreiber

(10) Patent No.: US 10,314,380 B2
(45) Date of Patent: Jun. 11, 2019

(54) APPLICATOR FOR COSMETIC PRODUCT AND ASSOCIATED APPLICATOR ASSEMBLY

(71) Applicant: Albea Services, Gennevilliers (FR)

(72) Inventor: Camille Schreiber, Paris (FR)

(73) Assignee: ALBEA SERVICES, Gennevilliers (FR)

( * ) Notice: Subject to any disclaimer, the term of this patent is extended or adjusted under 35 U.S.C. 154(b) by 574 days.

(21) Appl. No.: 14/521,560

(22) Filed: Oct. 23, 2014

(65) Prior Publication Data

US 2015/0117929 A1 Apr. 30, 2015

(30) Foreign Application Priority Data

Oct. 25, 2013 (FR) ..... 13 60435

(51) Int. Cl.

| | |
|---|---|
| ***A46B 11/00*** | (2006.01) |
| ***A45D 40/26*** | (2006.01) |
| ***A46B 9/02*** | (2006.01) |
| ***A46B 15/00*** | (2006.01) |
| *A45D 40/28* | (2006.01) |

(52) U.S. Cl.

CPC ..... *A45D 40/267* (2013.01); *A45D 40/262* (2013.01); *A46B 9/021* (2013.01); *A46B 15/0055* (2013.01); *A45D 40/28* (2013.01); *A46B 2200/1053* (2013.01)

(58) Field of Classification Search

CPC ..... A46B 2200/106; A46B 2200/1053; A46B 2200/46; A45D 40/262; A45D 40/267

USPC ..... 401/122–129, 121

See application file for complete search history.

(56) References Cited

U.S. PATENT DOCUMENTS

| | | | | |
|---|---|---|---|---|
| 2,496,010 A * | 1/1950 | Lotters | A46B 15/00 15/172 |
| 4,446,880 A * | 5/1984 | Gueret | A45D 40/265 132/218 |
| 4,662,385 A * | 5/1987 | Schefer | A45D 34/04 132/218 |
| 5,007,442 A * | 4/1991 | Hirzel | A45D 2/48 132/120 |
| 6,067,997 A | 5/2000 | Gueret | |

(Continued)

FOREIGN PATENT DOCUMENTS

| | | |
|---|---|---|
| EP | 1913836 A2 | 4/2008 |
| FR | 2518381 A1 | 6/1983 |

(Continued)

OTHER PUBLICATIONS

French Application 1360435, Search Report, dated May 27, 2014.

(Continued)

*Primary Examiner* — Jennifer C Chiang

(74) *Attorney, Agent, or Firm* — Banner & Witcoff, Ltd.

(57) ABSTRACT

The invention relates to an applicator for cosmetic product comprising a core, a plurality of protrusions projecting from the core to form a brush, and a spatula situated in the continuation of the core. The invention also relates to an applicator assembly for cosmetic product, comprising: a container comprising a body forming a reservoir intended to contain the cosmetic product, and an applicator as described above and suitable for being attached to the container, so that the applicator is accommodated inside the reservoir.

14 Claims, 4 Drawing Sheets

(56) References Cited

U.S. PATENT DOCUMENTS 6,309,125 B1 * 10/2001 Peters ..... A46B 11/0006 401/126
8,919,351 B1 * 12/2014 Wang ..... A46B 9/021 132/218
8,920,058 B2 * 12/2014 Simard ..... A46B 9/005 132/218
8,944,714 B2 * 2/2015 Gueret ..... A45D 40/267 401/126
9,055,804 B2 * 6/2015 Ornoski ..... A45D 40/265
2007/0256700 A1 * 11/2007 Bodelin ..... A45D 34/042 132/218
2010/0021225 A1 * 1/2010 De Laforcade ..... A45D 40/24 401/29
2010/0229319 A1 9/2010 Phillips
2011/0048448 A1 * 3/2011 Legassie ..... A45D 40/267 132/218
2011/0123248 A1 * 5/2011 Kim ..... A45D 2/48 401/1
2011/0297174 A1 * 12/2011 Ornoski ..... A45D 40/265 132/218
2011/0308031 A1 12/2011 Hartstock
2012/0009003 A1 * 1/2012 Gueret ..... A45D 34/042 401/121
2015/0230588 A1 * 8/2015 Pires ..... A45D 40/262 401/129
2015/0366326 A1 * 12/2015 Hauger ..... A46B 9/021 401/122

FOREIGN PATENT DOCUMENTS

FR 2837077 9/2003
IT MI2009A001873 4/2011

OTHER PUBLICATIONS

Nov. 16, 2017—(EP)—Office Action—App 14189110.1.
Oct. 16, 2017—(EP) Third Party Observations—App 14189110.1.
Jun. 11, 2018—(EP) Third Party Observations—App 14189110.1.

* cited by examiner

APPLICATOR FOR COSMETIC PRODUCT AND ASSOCIATED APPLICATOR ASSEMBLY

The present application claims priority to, and the benefit of, French Patent Application 1360435 filed Oct. 25, 2013, which is incorporated by reference herein in its entirety.

The invention relates to an applicator for cosmetic product and an associated applicator assembly.

There are known applicator assemblies for cosmetic product, in particular a cosmetic product intended to be applied to the eyelashes such as mascara, comprising a container containing the cosmetic product and an applicator suitable for being attached removably to the container.

The container generally comprises a body, the body comprising walls delimiting a reservoir in which the cosmetic product is contained, and a neck defining an opening through which the cosmetic product can be taken out.

The applicator assembly generally comprises a cap suitable for being attached to the neck, a rod extending from the cap and an applicator attached to a free end of the rod. The applicator comprises a core and a plurality of protrusions or bristles extending from the core.

When the cap is attached to the neck, the rod and the applicator extend inside the reservoir. The applicator is immersed in the cosmetic product contained in the reservoir.

In order to use the applicator, the user separates the cap from the neck and takes the applicator out of the container.

Furthermore, it is known that users who wish to apply cosmetic product to their eyelashes will wish to refine the anticipated effect by using other cosmetic applicators. For example, the applicator assembly intended for the eyelashes is often accompanied, in a user's make-up bag, by:

- a piece of felt allowing the outline of the eyes to be emphasised; and/or
- an applicator for make-up for the eyelids (generally a brush).

In order to limit the number of applicators, mascara brushes provided at their end with end pieces having a tapered shape have already been proposed. However, the make-up effects obtained are limited.

The present invention aims to solve the following problem: to propose an applicator that simplifies the application of eye make-up by limiting the number of applicators, while offering a wide range of make-up options.

Thus, the invention relates to an applicator for cosmetic product comprising a core, a plurality of protrusions projecting from the core to form a brush, and a spatula situated in the continuation of the core.

The advantage associated with the applicator of the invention lies in the possibility offered to users of applying a cosmetic product to their eyelashes, their eyelids, and around their eyes, doing so with the aid of a single applicator. This is because the applicant has noted that adding a spatula in the continuation of an applicator for eyelashes overcomes the disadvantage of changing the applicator for each desired effect (eyelashes, eyelids, outline of the eyes), this being done with a natural set of movements that allows a great variety of make-up.

An additional effect associated with the applicator according to the invention consists of the saving of cosmetic product. This is because users load the applicator of the invention only once and can subsequently take advantage of all the options that it offers, without having to reload it.

According to different embodiments of the invention, which can be taken together or separately:

- said spatula is configured to bend;

- the core has a first end, known as the proximal end of the core, and a second end, known as the distal end of the core;
- the core extends in a longitudinal direction, known as the main axis of extension;
- the spatula has a first end, called the proximal end of the spatula, and a second end, called the distal end of the spatula;
- the spatula extends from the distal end of the core, in the direction of the main axis of extension;
- the distal end of the spatula is free;
- the proximal end of the spatula and the distal end of the core merge into one another;
- the core has, along the main axis of extension, a first height H, from its proximal end to its distal end;
- the spatula has, from its proximal end to its distal end, along the same main axis of extension, a second height h;
- said heights H and h are such that $0.1 \leq h/H \leq 0.5$;
- the spatula has at least a first applicator face;
- said first applicator face extends along the same main axis of extension;
- the first applicator face has grooves;
- said grooves are oriented transversely to the main axis of extension;
- said grooves are substantially rectilinear;
- said grooves are substantially curved;
- the first applicator face is curved slightly inward;
- the first applicator face is plane;
- the spatula comprises a second applicator face;
- the first and second applicator faces are symmetrical relative to a plane passing through the main axis of extension, called the facial plane;
- the spatula comprises lateral surfaces connecting its applicator faces;
- said lateral surfaces have a curved profile, preferably convex;
- the spatula has a substantially rectangular transverse section;
- the distance separating the applicator faces of the spatula diminishes from the proximal end of the spatula to its distal end;
- the distance separating the applicator faces of the spatula is constant;
- the distal end of the spatula forms substantially a point in said facial plane, in such a way as to provide a particularly precise region for applying cosmetic product;
- said applicator faces have an ovoid profile;
- the core is solid;
- the core is of plastics material;
- the protrusions are of plastics material;
- the spatula is of plastics material;
- the protrusions and the spatula are of the same material;
- the spatula is fitted to the core;
- the spatula is overmoulded onto the core;
- the protrusions and/or the spatula form a single piece with the core;
- the core has a boundary portion, in particular a flared portion, forming a base of the spatula;
- said boundary portion, in particular said flared portion, carries at least some of said protrusions, called distal protrusions;
- the distal protrusions form an envelope in the shape of a truncated ogee;
- the protrusions are arranged in a plurality of rows;

said rows follow substantially helical lines, said lines being laid out on the surface of the core, from its proximal end to its distal end;

said rows are straight, parallel to the main axis of extension of the core;

said rows are inclined relative to the main axis of extension of the core while being parallel to one another.

The invention also relates to an applicator assembly for cosmetic product, comprising: a container comprising a body forming a reservoir intended to contain the cosmetic product, and an applicator, as described above, suitable for being attached to the container, so that the applicator is accommodated inside the reservoir.

According to different embodiments of the invention, which can be taken together or separately:

said container comprises a wiper;

the spatula is configured to brush past the wiper in a plurality of separate zones;

said separate zones are situated in the facial plane, either side of the main axis of extension;

the distance separating said separate zones is close to an internal diameter of the wiper.

The invention will be better understood, and its other aims, details, features and advantages will become more clearly apparent in the detailed explanatory description that follows, of at least one embodiment of the invention given as a purely illustrative and non-limiting example, with reference to the accompanying diagrammatic drawings.

The drawings illustrate an applicator for cosmetic product according to the invention comprising a core 12, a plurality of protrusions 30 projecting from the core 12, and a spatula 20 situated in the continuation of the core 12.

Figure 1:
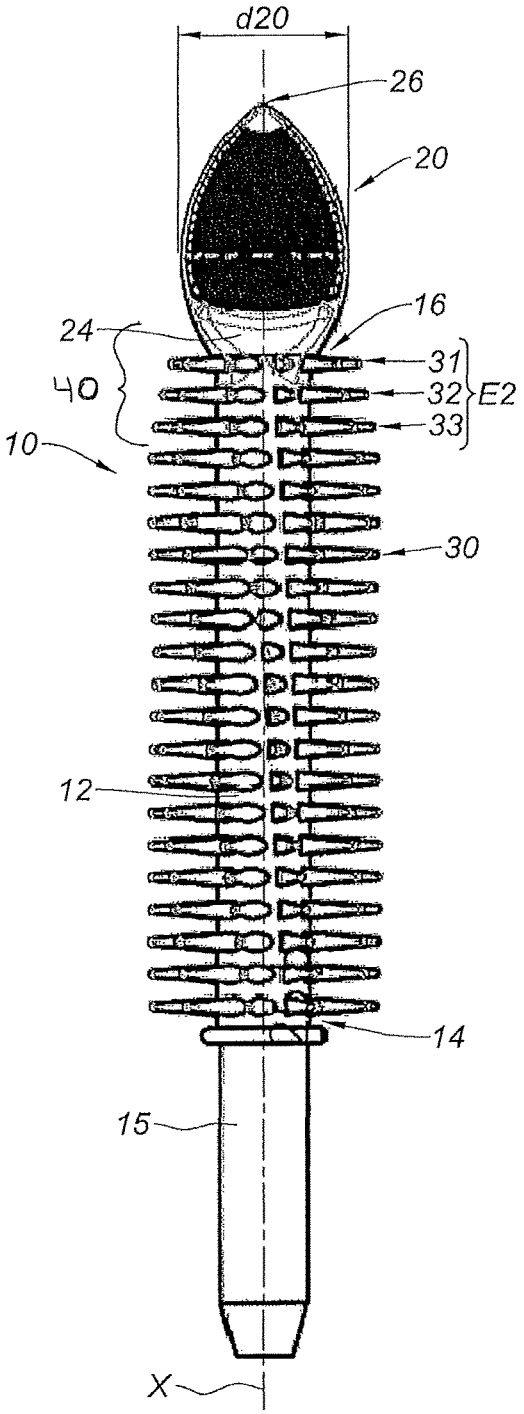
FIG. 1 is a view in elevation of an embodiment of an applicator according to the invention.

As shown in FIG. 1, the core 12 has a first end, called the proximal end 14 of the core, and a second end, called the distal end 16 of the core. The core 12 extends in a longitudinal direction of extension, called the main axis of extension, and referenced X in FIGS. 1 to 3 and 5.

The distal end 16 of the core 12 can be considered to be the zone situated just downstream of the last protrusions 30 going towards the spatula 20. The proximal end 14 of the core 12 can be considered to be the zone situated just upstream of the first protrusions 30 or, as here, the zone corresponding to a stop ring.

The spatula 20 also has a first end, called the proximal end 24 of the spatula, and a second end, called the distal end 26 of the spatula. The distal end 26 of the spatula is free.

The spatula 20 here extends from the distal end 16 of the core, in particular in the direction of the main axis of extension X. In other words, the proximal end 24 of the spatula 20 and the distal end 16 of the core 12 merge into one another as indicated by boundary portion 40.

In another embodiment, not illustrated, the core 12 can have a flared portion at its distal end 16, said flared portion of the core 12 forming a base for the spatula 20. In this embodiment too, the spatula can advantageously extend along the main axis of extension X of the core 12.

Figure 4:
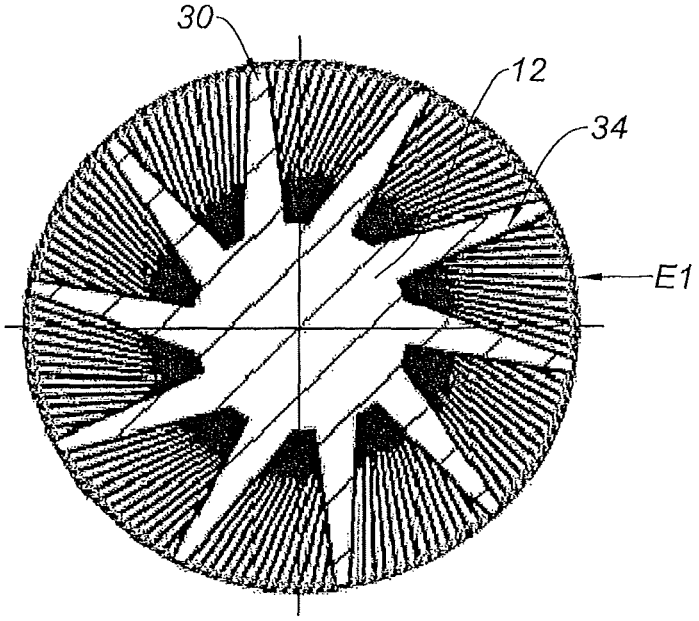
FIG. 4 is a view in cross section in the plane of cross section A-A referenced in FIG. 3.

The core 12 will preferably have a transverse section that is substantially constant from its proximal end 14 to its distal end 16, at least as far as its flared portion. As shown in FIG. 4, this transverse section will be substantially circular.

It should be noted that the core 12 of the applicator according to the invention, and the protrusions 30 that project from the core 12, form a brush 10.

Figure 2:
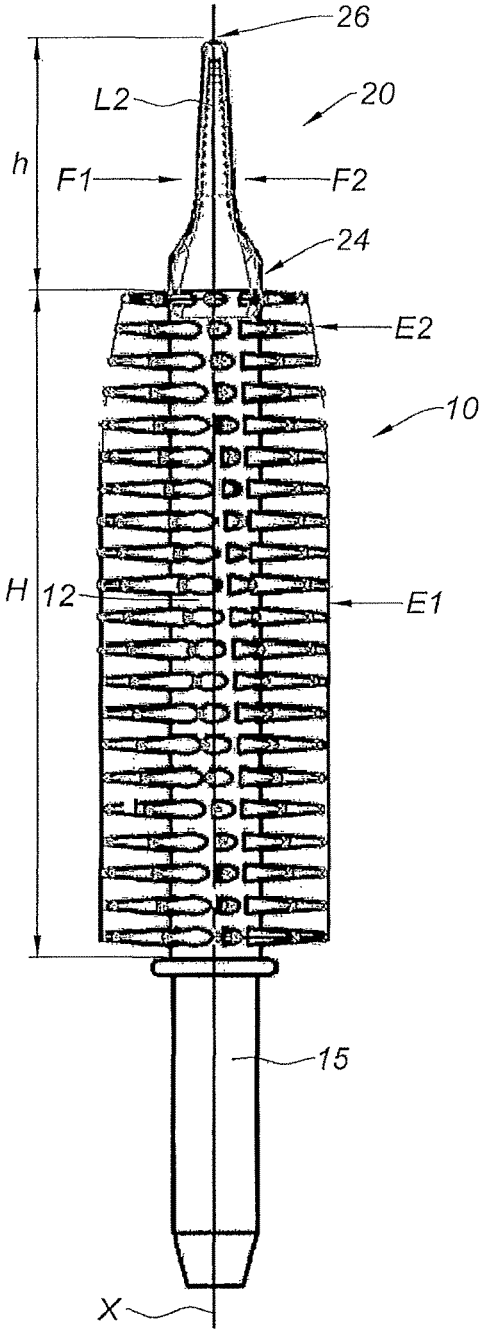
FIG. 2 is a view of the applicator shown in FIG. 1 after rotation through 90°.

As referenced in FIG. 2, the core 12 has, along the main axis of extension X, a first height H, while the spatula has, along the same main axis of extension, a second height h. Said heights H and h are such that $0.1 \leq h/H \leq 0.5$. For example, the height H can be approximately 21 mm and the height h approximately 8 mm.

Figure 5:
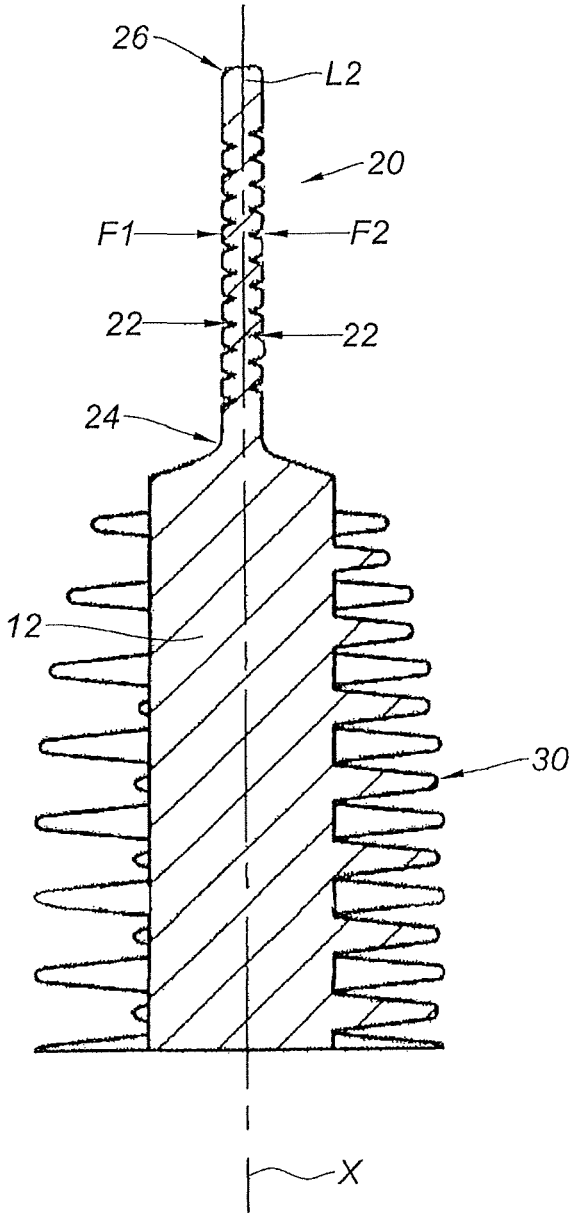
FIG. 5 is a detailed view of part of another embodiment.

In the embodiment shown partially in FIG. 5, the applicator will have a height H of approximately 18 mm and a height h of approximately 6 mm.

Furthermore, it is interesting to note that the spatula 20 is configured to bend. Specific parameters may advantageously play a part in this bending:

the particular technical form of the spatula 20; namely, two broad applicator faces F1, F2 and two thin lateral faces L1, L2; and/or grooves 22 provided on the applicator faces F1, F2.

Moreover, the particular technical form of the spatula 20 makes it possible to define, at its distal end 26, a shape that is substantially pointed, so as to offer a particularly precise region for applying cosmetic product.

The spatula 20 here has two applicator faces F1, F2. These faces F1, F2 extend, like the spatula 20, along the main axis of extension X. One of these faces, the face F1, is shown in detail in FIG. 3. They have, for example, an ovoid outline.

As shown in FIGS. 2 and 5, these faces F1, F2 are arranged symmetrically relative to a plane P, called the facial plane. This plane P can be seen in FIG. 3 (it is also the plane of the sheet of paper).

In order to connect the applicator faces F1, F2, the spatula 20 has lateral surfaces L1, L2. These lateral surfaces L1, L2 can have a curved profile, preferably convex. In an alternative embodiment (not shown), these lateral surfaces L1, L2 are rectilinear.

The distance separating said applicator faces F1, F2 of the spatula is arranged so that it decreases, from the proximal end 24 to the distal end 26 of the spatula 20. For example, the distance between said faces F1, F2 is approximately 2.8 mm at the proximal end 24 and approximately 0.6 mm at the distal end 26. It is in this way that the sharpened or pointed zone at the free end 26 of the spatula 20 is defined, in particular in the facial plane P.

In the embodiment of FIG. 5, the distance separating said faces F1, F2 is constant, and is approximately 0.6 mm.

Furthermore, as mentioned above, and as illustrated in detail in FIG. 3, the applicator faces F1, F2 have grooves 22. Said grooves 22 are oriented transversely to the main axis of extension X. They could also, in alternative embodiments (not shown) be oriented obliquely to the main axis of extension X, or even cover only a discrete portion of said applicator surfaces F1, F2; they could be substantially rectilinear, or even have an undulated profile.

Figure 3:
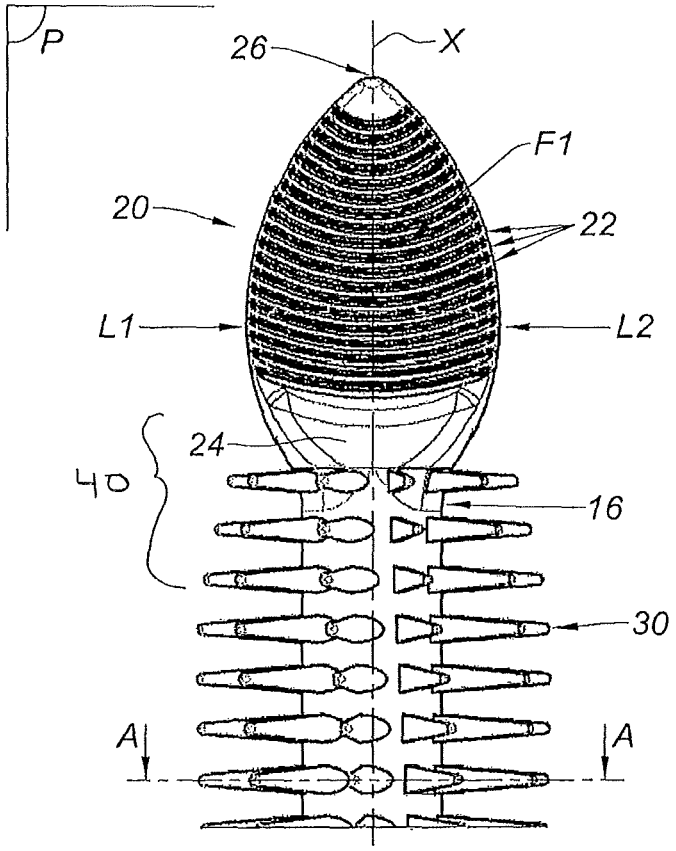
FIG. 3 is a detailed view of part of FIG. 1.

In the embodiment shown in FIGS. 3 to 4, said grooves are substantially curved.

The embodiment shown in FIG. 5 corresponds to rectilinear grooves 22, the grooves 22 made in the surface of the first applicator face F1 being offset, or staggered, relative to the grooves 22 made in the surface of the second applicator face F2. In other words, in the embodiment shown in FIG. 5, said grooves 22 will be distributed differently over each of the applicator faces F1, F2, said faces therefore not being symmetrical relative to the facial plane P, given the difference in the positioning of their grooves 22. Thus, the thickness of material along the main axis of extension X is substantially constant along the length of the spatula 20, from its proximal end 24 to its distal end 26.

The distribution of the grooves 22 of the first applicator face F1 relative to the distribution of the grooves 22 of the second applicator face F2 is such that it plays a part in making the spatula flexible and resilient.

In addition to the fact that they play a part in the bending of the spatula 20, said grooves 22 allow a fraction of cosmetic product to be retained on said applicator faces F1, F2 when the applicator according to the invention is loaded, this being done without said product being absorbed. This is because the grooves 22 create channels in which the formula is retained. In other words, the grooves 22 retain a fraction of cosmetic product by virtue of their technical form and not because of any porosity of the material of the spatula 20, said spatula being preferably made of a non-porous material.

The applicator according to the invention is particularly advantageous because it allows cosmetic product to be applied to emphasise the outline of the users eyes, this being effected by virtue of the lateral surfaces L1, L2 and/or by virtue of the point made at the distal end 26 of the spatula 20. Without needing to be reloaded, the applicator of the invention also allows cosmetic product to be applied to the user's eyelids in order to obtain the effect of an eyeshadow, this being done with the aid of the applicator faces F1, F2. Still without needing to be reloaded, the applicator of the invention, by virtue of the brush formed by the core 12 and the protrusions 30, allows product to be applied to the users eyelashes without applying cosmetic product to the user's nose. This is because the spatula 20 will be dimensioned in such a way that it does not come into contact with the user's nose when said user uses the applicator of the invention to apply make-up to her or his lashes.

It should be noted that the spatula 20 can be flexible in any plane secant to the facial plane P, preferably in any plane that includes the main axis of extension X and which is substantially orthogonal to said facial plane P.

One of the advantages associated with the flexibility of the spatula 20 consists of producing the same soft effect on the users eyelids as a brush. In order to further increase this effect, said spatula can take the form of fingers.

In the example shown in FIGS. 1 to 4, as can be seen in FIG. 2, the applicator faces F1, F2 are slightly incurved, preferably concave. They are generated by a straight line orthogonal to the main axis of extension X.

As for the protrusions 30, these project from the core 12. They are arranged in a plurality of rows which extend over the entire periphery of the core 12 (see FIG. 4).

The rows here have the feature of being inclined relative to the main axis of extension X. More precisely, said rows here follow substantially helical lines, said lines being laid out on the surface of the core 12, from its proximal end 14 to its distal end 16.

The rows can also be parallel to the main axis of extension X (alternative embodiment not shown).

The rows can also be inclined relative to said axis X, while being parallel to one another.

The radial separation between said rows around the periphery of the core 12 is made in accordance with a constant angular distance. Said angular distance will be within the interval [20°; 45°]; it will be approximately 30°. The embodiment shown here has ten rows, this number of rows varying according to the chosen angular distance between said rows.

It should be noted that the protrusions 30 of two adjacent rows are aligned axially relative to one another. They can also be offset axially relative to one another (alternative embodiment partially shown in FIG. 5).

Over a same axial portion, the rows have the same number of protrusions 30, to within one protrusion 30 more or less, for example twenty protrusions 30.

Furthermore, said protrusions 30 have, preferably, a semi-circular section. In other words, the protrusions 30 each have a plane surface 34.

The protrusions are here positioned so that the plane surfaces 34 of two adjacent protrusions 30 of two different rows are oriented in the same gyratory direction around the core 12 (see FIG. 4). In other words, the protrusions are positioned so that the plane surfaces 34 of two adjacent protrusions 30 are oriented in the same gyratory direction, in particular a gyratory direction identical to that of said helical rows in the case of the helical rows illustrated in FIGS. 1 to 4.

The term "gyratory direction" is understood to mean the gyratory direction observed by a person looking at the applicator of the invention from a point adjacent to the free distal end 26 of the spatula 20. Thus, no plane face 34 is opposite another plane face 34.

The moulding of said protrusions 30 with the core 12 will therefore be easy, because it allows the use of sliding mould cores that are simple in shape, all having substantially the same shape, and which are all oriented radially in the same direction.

The protrusions 30 will advantageously be rectilinear and furthermore, can be substantially tapered from their base to their free end.

Said protrusions 30 will all have substantially the same length. In other words, the distance between the radial periphery of the core 12 and the free end of the protrusions 30 will be substantially the same for all the protrusions 30 that the applicator comprises. An exception is made here, however, for the protrusions 31, 32, 33, called distal protrusions, that is to say, the protrusions 31, 32, 33 that extend close to the spatula 20.

These distal protrusions 31, 32, 33 form an envelope E2 in the shape of a truncated ogee (see FIGS. 1 and 2), while the protrusions 30 that extend between the proximal end 14 of the core and the distal protrusions 31, 32, 33 form a substantially cylindrical envelope E1 (see FIGS. 2 and 4).

The advantage associated with the ogee-shaped envelope E2 lies in the ease of maneuvering the applicator through the neck of the container from which it is taken.

In an embodiment not shown, the protrusions 30 will differ in height from one row to another.

Furthermore, the protrusions 30 will preferably be moulded using the same plastic as the core 12, or even forming a single piece with the core 12. The same applies to the spatula 20. Thus, said protrusions 30, like the spatula 20 described above, will form a single piece with the core 12. For example, the core 12, the protrusions 30 and said spatula 20 can be moulded in a material based on LDPE (low-density polyethylene). Other materials can be used, namely the material "Exact" from ExxonMobil or the material "Hytrel" from Dupont, or a mixture of these materials. Yet other materials can be used, for example: thermoplastic elastomers (TPE), thermoplastic polyurethane (TPU), styrene-butadiene styrene (SBS) copolymers and styrene-ethylene-butylene-styrene (SEBS), or even polyamide (PA).

The core will preferably be solid.

According to alternative embodiments, not shown, the spatula 20 could also be fitted to the core 12, by adhesion, by snap-fitting, by press-fitting, by friction-fitting, with the aid of an additional part, by screwing, or even be overmoulded onto the core. This makes it possible to provide a spatula 20 made in a material with different mechanical properties from the material in which the core 12 and/or the protrusions 30 will be made, or even in a different colour.

The invention also relates to an applicator assembly for cosmetic product, comprising: a container 50 comprising a body forming a reservoir intended to contain the cosmetic product (not shown), and an applicator, as described above, suitable for being attached to the container, so that the applicator is accommodated inside the reservoir. Said applicator is attached, for example, to the end of a rod, the rod itself being attached to a cap that is, advantageously, screwed to the container.

It should be noted that after fitting, the cylindrical coupling 15 is situated in the rod and the proximal end 14 of the core 12 corresponds to the distal end of the rod. On this subject, said applicator can comprise a cylindrical coupling 15, provided in the continuation of the proximal end of the core 12 (see FIGS. 1 and 2). Said cylindrical coupling 15 here extends from the stop ring 14.

Figure 6:
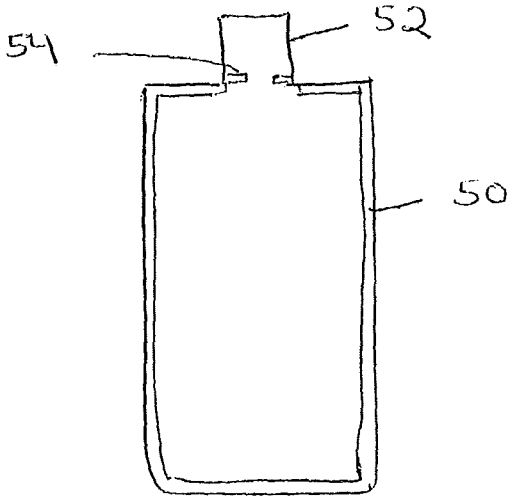
FIG. 6 is a view in elevation of a cross-section of a container having a wiper.

In addition, to prevent the applicator from being overloaded with cosmetic product, as shown in FIG. 6, the container 50 can comprise a wiper 54, attached to the interior of the neck 52. When the user takes the applicator out of the container, the applicator slides inside the wiper. The wiper wipes off excess cosmetic product on the rod and on the applicator.

The wiper thus makes it possible to regulate the amount of product present on the applicator and prevents excessive application of cosmetic product to the eyelashes.

It should be noted that the spatula 20 according to the invention is configured to brush past the wiper in a plurality of separate zones. "Brush past" is understood to mean: to come into proximity, with or without contact. In other words, there is a slight play, or even a slight friction, between the spatula 20 and the wiper, for example originating in a difference in dimensions of less than 1 mm, or 0.5 mm, or even 0.2 mm.

In this way, an effect of shearing off the residual cosmetic product situated on the spatula 20 is obtained. The applicator assembly proposed thus makes it possible to limit the presence at the free end of the applicator of residual cosmetic product, which remains in the container by virtue of the shearing. The applicator remains clean and the cosmetic product can be applied to the eyelashes with suitable precision and without overloading.

Said separate zones are situated in the facial plane P, on either side of the main axis of extension: they are the extremums of the lateral faces L1, L2 described above; in other words, these are the zones where the external dimension of the spatula 20 is at a maximum d20 (see FIG. 1).

The distance separating said separate zones is similar to an internal diameter of the wiper. For example, said external dimension d20 can be approximately 5 mm and the internal diameter of the wiper can be approximately 5.3 mm. This means, for example, that the play existing between the spatula 20 and the wiper, at least in proximity to said zones intended to brush past the wiper, is 0.15 mm.

It should also be noted that variants are of course possible. In particular, it is also conceivable, in additional embodiments, that the applicator has a flat core or even a core with a polygonal section, and/or a curved core.

The alternative and additional embodiments presented above can be combined with one another, without departing from the scope of the invention. Furthermore, they are not limiting.

The invention claimed is:

1. Applicator for cosmetic product comprising:

a core, a plurality of protrusions projecting from the core to form a brush, and a spatula situated in the continuation of the core, wherein the protrusions and the spatula form a single piece with the core, said spatula configured to bend.

2. Applicator according to claim 1, wherein the core has a first end, called the proximal end of the core, and a second end, called the distal end of the core, said core extending in a longitudinal direction of extension, called the main axis of extension (X), and wherein the spatula has a first end, called the proximal end of the spatula, and a second end, called the distal end of the spatula, and wherein the spatula extends from the distal end of the core, in the direction of the main axis of extension (X), the distal end of the spatula being free.

3. Applicator according to claim 2, wherein the core has, along the main axis of extension (X), a first height H from its proximal end to its distal end, and wherein the spatula has, from its proximal end to its distal end, along the same main axis of extension (X), a second height h, such that $0.1 \leq h/H \leq 0.5$.

4. Applicator according to claim 2, wherein the spatula has at least a first applicator face (F1).

5. Applicator according to claim 4, wherein said first applicator face (F1) has grooves oriented transversely to the main axis of extension (X).

6. Applicator according to claim 4, wherein said first applicator face (F1) is plane.

7. Applicator according to claim 4, wherein the spatula comprises a second applicator face (F2).

8. Applicator according to claim 7, wherein the first and second applicator faces (F1, F2) are symmetrical relative to a plane passing through the main axis of extension (X), called the facial plane (P).

9. Applicator according to claim 8, wherein the distal end of the spatula forms substantially a point in said facial plane (P), in such a way as to provide a particularly precise region for applying cosmetic product.

10. Applicator according to claim 1, wherein the protrusions and the spatula are moulded with the core.

11. Applicator according to claim 1, wherein the core has a boundary portion forming a base of the spatula.

12. Applicator according to claim 11, wherein said boundary portion carries at least some of said protrusions, called distal protrusions.

13. Applicator assembly for cosmetic product, comprising:

a container comprising a body forming a reservoir intended to contain the cosmetic product, and an applicator according to claim 1, suitable for being attached to the container, so that the applicator is accommodated inside the reservoir.

14. Applicator assembly according to claim 13, wherein said container comprises a wiper and wherein the spatula is configured to brush past the wiper in a plurality of separate zones.

* * * * *